US007164394B2

(12) United States Patent
Hirose et al.

(10) Patent No.: US 7,164,394 B2
(45) Date of Patent: Jan. 16, 2007

(54) PLASMA DISPLAY APPARATUS

(75) Inventors: Tadatsugu Hirose, Kawasaki (JP); Yoshiho Seo, Kawasaki (JP); Tomokatsu Kishi, Kawasaki (JP); Takahiro Takamori, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/102,017

(22) Filed: Mar. 21, 2002

(65) Prior Publication Data

US 2003/0020673 A1 Jan. 30, 2003

(30) Foreign Application Priority Data

Jul. 24, 2001 (JP) ..... 2001-223443

(51) Int. Cl.
*G09G 3/28* (2006.01)

(52) U.S. Cl. ..... 345/60; 315/169.4

(58) Field of Classification Search ..... 345/55, 345/60–67, 68, 80, 76; 315/169.1, 169.2, 315/169.4, 166, 168; 313/484, 582–585
See application file for complete search history.

(56) References Cited

U.S. PATENT DOCUMENTS

| | | | | |
|---|---|---|---|---|
| 3,646,384 | A | 2/1972 | Lay | |
| 3,811,061 | A | 5/1974 | Nakayama et al. | |
| 4,164,678 | A | 8/1979 | Biazzo et al. | |
| 6,087,779 | A * | 7/2000 | Sakamoto et al. | 315/169.1 |
| 6,195,070 | B1 * | 2/2001 | Shinoda et al. | 345/60 |
| 6,195,074 | B1 * | 2/2001 | Kim | 345/67 |
| 6,388,644 | B1 * | 5/2002 | De Zwart et al. | 345/60 |
| 6,448,947 | B1 * | 9/2002 | Nagai | 345/60 |
| 6,456,265 | B1 * | 9/2002 | Mikoshiba et al. | 345/66 |
| 6,476,562 | B1 | 11/2002 | Yoo et al. | |
| 6,501,445 | B1 * | 12/2002 | Kim | 345/61 |
| 6,512,499 | B1 * | 1/2003 | Abe | 345/60 |
| 6,522,314 | B1 * | 2/2003 | Tomio et al. | 345/68 |
| 6,838,824 | B1 * | 1/2005 | Shinoda et al. | 313/582 |
| 2002/0093291 | A1 * | 7/2002 | Kanazawa et al. | 315/169.4 |
| 2002/0149548 | A1 * | 10/2002 | Akiba | 345/60 |
| 2003/0080926 | A1 * | 5/2003 | Morimoto | 345/60 |

FOREIGN PATENT DOCUMENTS

| | | |
|---|---|---|
| JP | 5-101781 | 4/1993 |
| JP | 11-288666 | * 10/1999 |
| JP | 2000-047632 | 2/2000 |
| JP | 2000-341472 | * 12/2000 |

OTHER PUBLICATIONS

Notification of the First Office Action for Chinese Application No. 02105797.4.

* cited by examiner

*Primary Examiner*—Richard Hjerpe
*Assistant Examiner*—Abbas Abdulselam
(74) *Attorney, Agent, or Firm*—Staas & Halsey LLP

(57) ABSTRACT

A PDP apparatus of good display quality has been disclosed, wherein plural common electrodes and plural scan electrodes that extend in the directions perpendicular to each other are formed on a first substrate and plural address electrodes that respectively make a pair with the plural common electrodes and extend in the same direction of that thereof are formed on a second substrate. A display cell is formed at the crossing portion of each pair of the common electrode and the address electrode and each scan electrode, the lit state or the unlit state of each display cell is selected by applying a scan pulse sequentially to the scan electrode and applying an address pulse selectively to the address electrode in synchronization with the application of the scan pulse, and a sustain pulse is applied to the plural common electrodes and the plural scan electrodes.

21 Claims, 17 Drawing Sheets

PLASMA DISPLAY APPARATUS

BACKGROUND OF THE INVENTION

The present invention relates to a plasma display apparatus. More particularly, the present invention proposes a three-electrode AC (alternate current) type surface discharge plasma display apparatus with a new structure.

The plasma display apparatus (PDP apparatus) has been put to practical use as a flat display and is highly regarded as a thin high-luminance display. Among several types of the PDP apparatus, an AC type PDP, in which the light emission display is performed by applying a voltage waveform alternately to two sustain electrodes to keep on causing a discharge to occur, is mostly used. A discharge is completed 1μ second to a few μ seconds after the application of a pulse. Ions, which are positive charges generated by a discharge, accumulate on the surface of the insulating layer on an electrode to which a negative voltage is being applied, and electrons, which are negative charges, accumulate on the surface of the insulating layer on an electrode to which a positive voltage is being applied.

Therefore, after wall charges are first formed on a cell to be displayed by selectively causing a discharge to occur with a pulse (write pulse) of a high voltage (write voltage), if a pulse (sustain pulse or sustain discharge pulse) of a voltage lower (sustain voltage or sustain discharge voltage) than before and of the opposite polarity is applied, a threshold value of discharge voltage is exceeded and a discharge is caused to occur in the cell to be displayed because the voltage due to the wall charges accumulated thereon is overlapped and a large voltage develops across the discharge space. (A discharge is not caused to occur in a cell not to be displayed, to which a write pulse has not been applied, even if a sustain pulse is applied.) In other words, a cell, in which wall charges have been formed once by a write discharge, has a characteristic that a discharge is kept on by continuing to apply a sustain pulse, the polarity of which being alternately reversed. This is called the memory effect. Generally, an AC type PDP apparatus performs a display by utilizing this memory effect.

The AC type PDP apparatuses include the two-electrode type, in which a selection discharge (address discharge) and a sustain discharge are caused to occur by two electrodes, and the three-electrode type, in which an address discharge is caused to occur by utilizing a third electrode. The color PDP apparatus that performs a gray level display excites the phosphor formed in a discharge cell by the ultraviolet rays generated by a discharge, but the phosphor has a drawback of being susceptible to the impact of ions, which are positive charges generated by the discharge. Because the above-mentioned two-electrode type has a structure in which the phosphor is directly hit by ions, the life of the phosphor may be shortened. To avoid this, a color PDP apparatus generally employs the three-electrode structure that utilizes the surface discharge. The three-electrode type further includes two types: in one type a third electrode is formed on the same substrate on which a first and a second electrodes that perform the sustain discharge have been arranged, and in the other type the third electrode is arranged on another opposing substrate. On the other hand, when the three kinds of electrodes are formed on the same substrate, there are two types: in one type the third electrode is arranged over the two electrodes that perform the sustain discharge, and in the other type the third electrode is arranged thereunder. Still furthermore, there are two types: in one type the visible light emitted from the phosphor is viewed therethrough (transparent type), and in the other type that reflected by the phosphor is viewed (reflection type).

FIG. 1 is a rough plan view of the panel to be used in the above-mentioned three-electrode surface discharge AC type PDP apparatus. FIG. 2 is a rough sectional view in the vertical direction of a discharge cell of the panel in FIG. 1 and FIG. 3 is that in the horizontal direction that shows an example of the reflection type in which part of the sustain electrode is formed by a transparent electrode on the panel on which the third electrode (address electrode) is formed on another substrate different from and opposing the substrate having the electrodes that perform the sustain discharge.

As shown in FIG. 1, plural first electrodes (X electrodes) 12 and second electrodes (Y electrodes) 11-1 to 11-N are arranged adjacently by turns and plural third electrodes (address electrodes) 13-1 to 13-M are arranged in the direction perpendicular thereto. A partition wall 14 is formed between address electrodes. The X electrodes 12 are connected commonly. A display cell is formed at the crossing of each pair of the X electrode 12 and the Y electrode 11 and each address electrode 13. Therefore, each display cell is separated in the horizontal direction by the partition wall 14 but is continuous with the display cells contiguous thereto in the perpendicular direction. Therefore, the gap between the pairs of the X electrode 12 and the Y electrode 11 is vertically widened to prevent adjacent display cells from affecting each other.

The panel is composed of two glass substrates 21 and 29. On the first substrate 21, the plural first electrodes (X electrodes) 12 and the plural second electrodes (Y electrodes) 11, which correspond to the sustain electrodes and are arranged adjacently by turns, are formed and these electrodes are composed of transparent electrodes 22*a* and 22*b* and bus electrodes 23*a* and 23*b*. Because of the role to allow the light reflected by the phosphor to pass through, the transparent electrode is made of such as ITO (transparent film the main component of which is indium oxide). The bus electrode needs to be made of a material of a low resistance therefore is made of Cr (chromium) or Cu (copper), because it is necessary to avoid the reduction in voltage due to the electrical resistance. Moreover, the bus electrode is covered with a dielectric layer (glass) 24 and an MgO (magnesium oxide) film 25 is formed as a protection film on the discharge surface. On the other hand, on the second substrate 29 that opposes the first glass substrate 21, the plural third electrodes (address electrodes) 13 are formed in the direction perpendicular to that of the sustain electrodes (X, Y electrodes). The partition wall 14 is formed between the address electrodes and between the partition walls, phosphors 27 that have the light emission characteristics of red (R), green (G), and blue (B) are formed so as to cover the address electrode. The two glass substrates are assembled so that the ridge of the partition wall 14 and the MgO film 25 come into close contact with each other. The space between the phosphor 27 and the MgO film 25 is a discharge space 26.

The method to drive the above-mentioned three-electrode surface discharge AC type PDP apparatus is called the "Address/sustain discharge period separated type-write address method". This drive method is briefly described below. In the first reset period, each display cell is set to a uniform state. In this reset period, all the display cells are set to a uniform state by applying a voltage sufficiently greater than the threshold voltage between the X electrode and the Y electrode to cause a discharge to occur, while a fixed voltage (0V, for example) is being applied to the address electrode, then neutralizing the charges generated by the discharge by making the potentials of the X electrode and the Y electrode equal to each other. In the next address discharge period, with a state in which a fixed voltage is being applied to the X electrode, a scan pulse of, for example, −150 V is applied sequentially to the Y electrode, a write pulse (of 50 V, for example) is applied to the address electrode of a cell to be made to emit light in synchronization with the application of each scan pulse, and no write pulse is applied (that is, 0 V is applied) to the address electrode of a cell not to be made to emit light. In this way, a discharge is caused to occur in a cell to be made to emit light and wall charges are formed on the surface of the dielectric on the X electrode and the Y electrode, but no wall charge is formed in a cell not to be made to emit light. In the next sustain discharge period, with a state in which a fixed voltage (0 V, for example) is being applied to the address electrode, a sustain pulse is applied alternately to the X electrode and every Y electrode. The sustain pulse has such a voltage (180 V, for example) that a sustain discharge is caused to occur in a cell to be made to emit light, in which the wall charges have been formed during the address discharge period, by overlapping the voltage due to the wall charges because the threshold voltage is exceeded, but no discharge is caused to occur in a cell not to be made to emit light in which no wall charge has been formed. As the occurrence of a sustain discharge forms the wall charges of the opposite polarity, a discharged is caused to occur if a sustain pulse of the opposite polarity is applied subsequently. In this way, a discharge is kept on, due to the memory effect, by applying a sustain pulse the opposite polarity of which is alternately changed. What contributes to the display is this sustain discharge and, the longer the sustain discharge period, the higher the light emission luminance is. By repeating the above-mentioned reset period, address discharge period, and sustain discharge period, the display is performed.

In the PDP apparatus, it is possible only to control the display cell whether to emit light or not, but the light emission intensity cannot be changed for each display cell. Therefore, when the gray level display is performed, one display frame is made to comprise plural subframes. Each subframe is composed of a reset period, an address discharge period, and a sustain discharge period, and the light emission intensity is varied by changing the length of the sustain discharge period. Then, a desired light emission luminance can be obtained by selecting the subframes to be made to emit light in one display frame for each display cell.

The PDP apparatus comprises a drive circuit to apply a voltage to each electrode of the panel described above, a frame memory to convert display data into a signal appropriate for the drive signal in the PDP apparatus, control circuits of each part, and so on, and, as these are widely known, a description is omitted here. Although various examples of modification to such as the panel structure and the drive method have been proposed, no description about these is provided here.

For the three-electrode surface discharge AC type PDP apparatus that has been known so far, various figures of the electrode to improve the discharge efficiency have been proposed, but it can be said, on the whole, that the X electrode and the Y electrode, which are the sustain electrodes, are designed so as to extend in the same direction.

For a gas discharge display apparatus such as the PDP apparatus that performs the image display, it is required to prevent a discharge in a display cell from affecting adjacent display cells to cause a discharge to occur in a cell not to be made to emit light, and to keep on causing a discharge to occur in a cell to be made to emit light, therefore, a structure in which display cells are separated is needed. In the above-mentioned three-electrode surface discharge AC type PDP apparatus, for example, the gap between the pairs of the x electrode 12 and the Y electrode 11 is vertically widened to prevent adjacent display cells from affecting each other and the wall partition 14 is provided to horizontally separate the display cells, as described above. Such a structure, however, has the following problems. One of them is that although the wall partition is separated horizontally, if there exists a flaw in the wall partition, a charge may flow to an adjacent cell, not to be made to emit light, through it, a discharge may be caused to occur in the cell not to be made to emit light by the charge as a trigger, and an erroneous display may be caused. Another problem is that the gap between the pairs of the X electrode 12 and the Y electrode 13 is vertically widened to prevent a discharge from being caused to occur, therefore, the vertical interval between the display cells needs to be also widened, and as a result the density of display cells cannot be increased.

Moreover, the panel structure of the above-mentioned three-electrode surface discharge AC type PDP apparatus has still another problem that since the sustain electrodes (X electrodes and the Y electrodes) are arranged in parallel, the panel volume becomes large and it is necessary to use a drive circuit of a higher performance accordingly, resulting in a larger power consumption and a higher cost.

SUMMARY OF THE INVENTION

The present invention will solve these problems and the objective is to realize a PDP apparatus that is able to prevent an erroneous display by defining the range of each display cell with a structure of an electrode and has a high density of display cells, and to reduce the power consumption and the cost.

FIG. 4 is a diagram that shows the fundamental structure of the plasma display panel (PDP) used in the PDP apparatus of the present invention. As shown in FIG. 4, in order to realize the above-mentioned objective, in the plasma display apparatus of the present invention, plural common electrodes X and plural scan electrodes Y that respectively extend in directions perpendicular to each other are formed on a first substrate 34, and plural address electrodes A that extend in the same direction as that of the plural common electrodes X corresponding thereto (i.e., each address electrode A is aligned with a respective common electrode X) are formed on a second substrate 36, opposed to the first substrate 34 and forms a display space 37 therebetween. A display cell is formed at the crossing portion of each common electrode X and address electrode A pair and each scan electrode Y, the lit state or the unlit state of each display cell is selected by applying a scan pulse sequentially (i.e., in individual succession) to the plural scan electrodes Y and at the same time (i.e., synchronously with the scan pulse) applying an address pulse selectively to the plural address electrodes A in synchronization with each scan pulse, and a sustain discharge is produced in a display cell to be lit by applying a sustain pulse alternately to the plural common electrodes X and the plural scan electrodes Y.

As shown schematically, at the crossing portion on the first substrate 34, the common electrode X is provided under the scan electrode Y via a dielectric layer 35 and the scan electrode Y is arranged on the side near the address electrode A.

FIG. 5A through FIG. 5E and FIG. 6A and FIG. 6B are diagrams that illustrate the operation of the PDP apparatus of the present invention, and FIG. 5A and FIG. 5C are sectional views viewed from the direction perpendicular to the scan electrode Y and FIG. 5B and FIG. 5D are those viewed from the direction perpendicular to the common electrode X. As in the conventional way, an erase discharge is caused to occur by applying an erase pulse between the X electrode and the Y electrode and all the display cells enter a uniform state. Then, while a voltage Vx is being applied to the common electrode, a scan pulse of voltage −Vy is applied sequentially to the scan electrode Y and at the same time an address pulse is applied selectively to the plural address electrodes A in synchronization with each scan pulse. The address pulse applies a voltage Va to a cell to be made to emit light and a voltage 0V, to a cell not to be made to emit light. In this way, no discharge is caused to occur in a cell not to be made to emit light, but a discharge is caused to occur in a cell to be made to emit light because the voltage between the scan electrode Y and the address electrode A exceeds the discharge start voltage, and positive charges and negative charges are formed on the cell to be made to emit light in the discharge space, as shown in FIG. 5A.

As described above, the voltage Vx is being applied to the common electrode X, an electric field is formed between the common electrode X and the scan electrode Y, and the generated positive charges and negative charges are accumulated on the dielectric layer 35 on the common electrode X and the scan electrode Y according to the electric field. This is shown in FIG. 5C through FIG. 5E. By performing this action sequentially on every scan electrode Y, wall charges are formed on a cell to be made to emit light in the arrangement shown in FIG. 5E.

FIG. 6A and FIG. 6B are diagrams that illustrate the discharge start voltage between the common electrode X and the scan electrode Y. As shown in FIG. 6A, as the common electrode X and the scan electrode Y are perpendicular to each other, the gap d between the electrodes at the point of the distance r from the crossing portion can be obtained as $d=\sqrt{2}\times r$. FIG. 6B shows the Paschen curve that represents the discharge start voltage Vf with respect to the product Pd of the pressure P within the discharge space and the discharge gap d. From this diagram, it is known that the Paschen curve has the characteristic of being convex downward and the voltage is below the voltage Vt in the domain between Pd1 and Pd2. Since the pressure P is constant, the domain between Pd1 and Pd2 corresponds to range of the discharge gap between d1 and d2, corresponding to the distance between r1 and r2 from the crossing portion. By applying the sustain discharge voltage Vs to the scan electrode Y, a discharge is caused to occur when the voltage due to the wall charges accumulated on the common electrode X and the scan electrode Y is overlapped and the voltage Vt is exceeded, and wall charges of the opposite polarity are accumulated on the common electrode X and the scan electrode Y. Therefore, by applying the sustain discharge voltage Vs to the common electrode X, a discharge is caused to occur and wall charges are accumulated. By repeating this action, the sustain discharge is caused to occur repeatedly. As shown in FIG. 6B, when the discharge gap d becomes larger as the distance from the crossing portion of the common electrode X and the scan electrode increases, the discharge start voltage also becomes higher, therefore, a discharge is hardly caused to occur and it is unlikely that the discharge propagates. In other words, a discharge is caused to occur only when the distance from the crossing section is between r1 and r2.

As described above, in the plasma display apparatus of the present invention, as the scan electrode extends in the direction perpendicular to those of the common electrode and the address electrode, if a voltage is applied between the scan electrode and the common electrode or between the scan electrode and the address electrode, the electric field intensity becomes the strongest at the crossing portion and its vicinity and it decreases as the distance from the crossing portion increases. Therefore, when a discharge or a sustain discharge is caused to occur to select the lit state or the unlit state of each display cell by applying a voltage between the scan electrode and the common electrode or between the scan electrode and the address electrode, the discharge is limited to the crossing portion and its vicinity and is hardly propagated to adjacent display cells, therefore, an erroneous display can be avoided. Because of this, it will be possible to remove the partition wall used conventionally, and to realize a PDP apparatus, in which the density of display cells is high. Moreover, since the common electrode and the scan electrode, between which a discharge is caused to occur, are perpendicular to each other, the volume and power consumption can be made less compared to a conventional one in which they are parallel and at the same time the cost can also be reduced because it is possible to use a circuit with a lower drive performance.

When the scan electrode and the common electrode are provided on the first substrate, they are made to form plane layers the height of which are different from each other, and the dielectric layer is provided therebetween. In this case, since the volume of the crossing portion becomes large, it is designed so that the common electrode has a step that makes a roundabout way to avoid around the scan electrode and protrudes downward at the crossing portion, or the scan electrode has a step that makes a roundabout way to avoid the common electrode and protrudes upward at the crossing portion. If such a structure is employed, it will be possible to provide a scan electrode and a common electrode flush with each other, on the first substrate, except for the crossing portion.

It is possible to reduce the volume of the crossing portion by providing a structure of a dielectric on the crossing portion of the common electrode and forming the scan electrode thereon instead. Moreover, it is also preferable to provide the structure of a dielectric along the entire length of the scan electrode thereunder.

The address electrode can be exposed to the discharge space.

As described above, a discharge is caused to occur in a part a certain distance away from the crossing portion of the scan electrode Y, and the crossing portion only generates charges by a discharge between the crossing portion and the address electrode and is not required to accumulate wall charges. Therefore, part of the scan electrode can be exposed to the discharge space and this will lower the voltage needed to cause an address discharge to occur. It is not necessary for the whole part of the crossing portion of the scan electrode to be exposed, and it is preferable, for example, to provide plural pores that connect the discharge space and the scan electrode at the crossing portion of the scan electrode.

It is also preferable to provide a common auxiliary electrode and a scan auxiliary electrode that are connected to the common electrode and the scan electrode, respectively, and widen the common electrode and the scan electrode in the vicinity of the crossing portion in order to make the gap constant. In this case, if the surfaces of the common auxiliary electrode and the scan auxiliary electrode are made to have the same depth from the surface that comes into contact with the discharge space, the thickness of the dielectric layer between the common electrode provided downward and the surface can be reduced, and as a result, the sustain discharge voltage can be reduced.

According to the present invention, as the address discharge is limited to the crossing portion and the sustain discharge is limited in the vicinity of the crossing portion, it is possible to omit the partition wall that has been used conventionally, but it is also possible to provide the partition wall. When the partition wall is provided, it is preferable to provide on the surface of the second substrate so as to separate the address electrodes, as conventionally. This wall partition can also be used to define the interval between the first substrate and the second substrate. It is also preferable to make the partition lower and use it to distinguish between the phosphors or to provide a spacer in addition to such a low partition wall and use it to define the interval between the substrates by combining them.

If the pixel pitch of the display screen in the horizontal direction is to be made equal to that in the vertical direction, the arrangement pitch of the scan electrode needs to be made equal to those of the common electrode and the address electrode. In the color display, however, R (red), G (green), and B (blue) phosphors are formed in three adjacent display cells and a one-color pixel is composed of these three display cells. It is preferable that the one-color pixel has the same pixel pitch in the horizontal direction as that in the vertical direction. Therefore, if a scan pulse is applied to a group composed of the three adjacent scan electrodes, the lit state or the unlit state of the three adjacent display cells formed by the three adjacent scan electrodes can be selected simultaneously by one scan pulse. Since the one-color pixel is composed of 3×3, that is nine, display cells, the pixel pitch in the horizontal direction and that in the vertical direction become equal to each other.

It is also acceptable to make the arrangement pitch of the scan electrode three times those of the common electrode and the address electrode. In this case, a common auxiliary electrode and a scan auxiliary electrode, for example, which extend in the same direction of the common electrode and the address electrode are provided, because it is necessary to extend the light emission range (sustain discharge range) of each display cell in this direction.

Moreover, by arranging the three pixels R, G, and B at the vertexes of a grid, each grid unit of which is an equilateral triangle, the pixel pitch of the one-color pixel in the horizontal direction can be substantially made equal to that in the vertical direction. In order to realize such an arrangement, the scan electrode is made to turn in zigzag so that the crossing with the common electrode forms a vertex.

It is preferable to be able to adjust the luminance independently for each pixel of each color because each phosphor of R, G, and B differs in light emission efficiency. Therefore, by grouping the common electrode of each display cell by light emission color to enable to drive each group independently, and by setting independently the application period of the sustain pulse to be applied in the sustain discharge period for each group, the luminance and chromaticity can be adjusted for each color pixel.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 1:
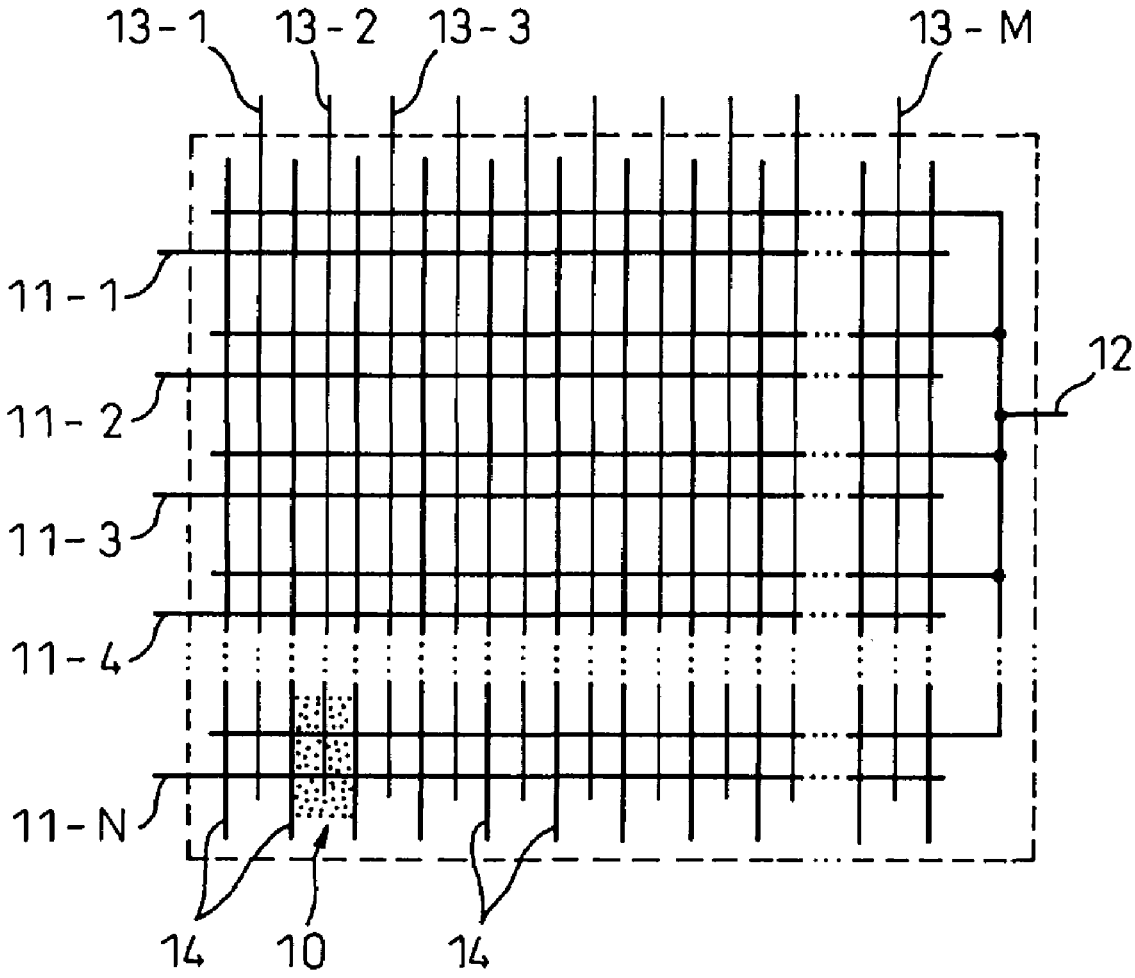
FIG. 1 is a rough plan view of the three-electrode surface discharge AC type PDP.
Figure 2:
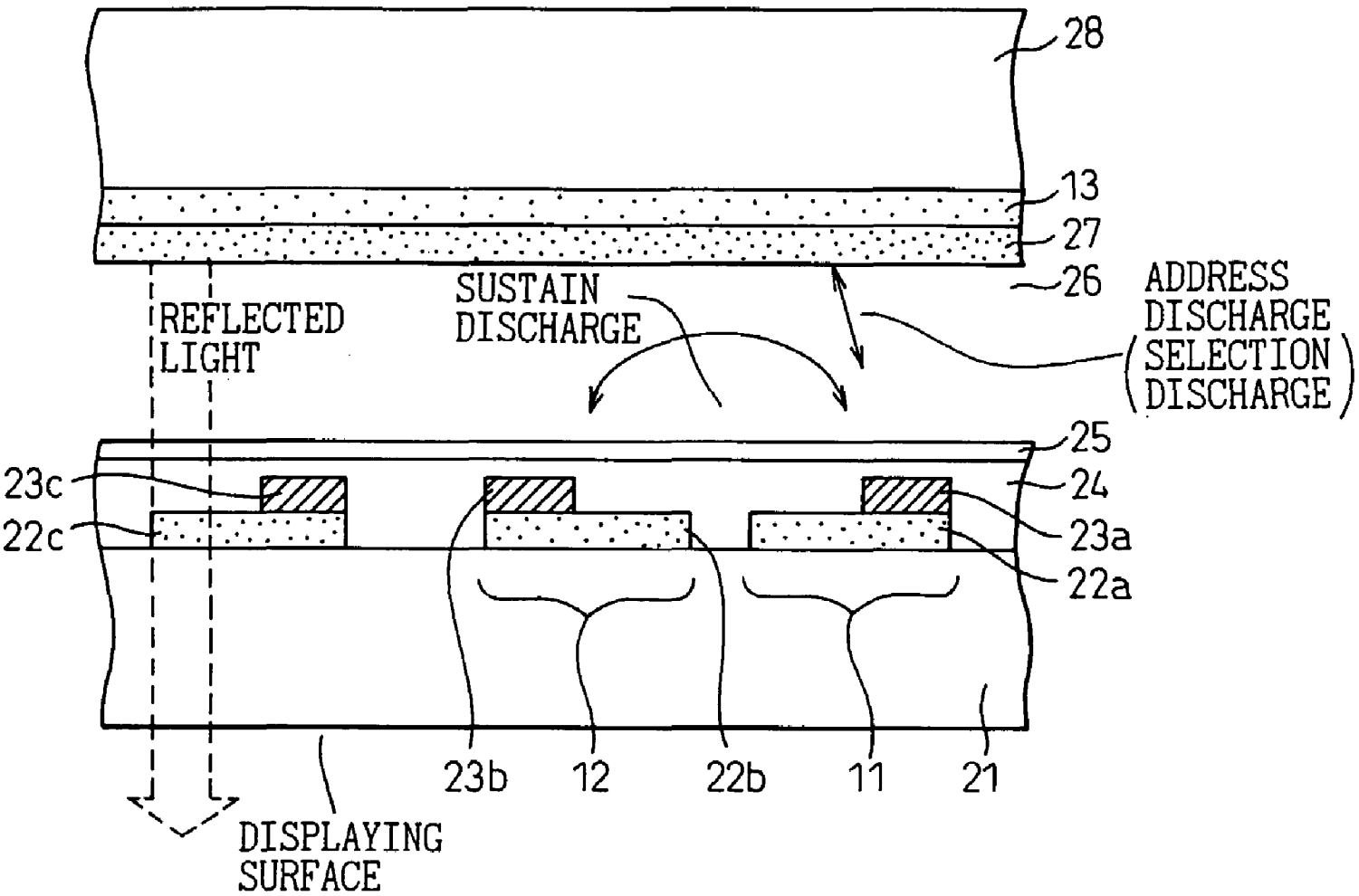
FIG. 2 is a rough sectional view of the three-electrode surface discharge AC type PDP.
Figure 3:
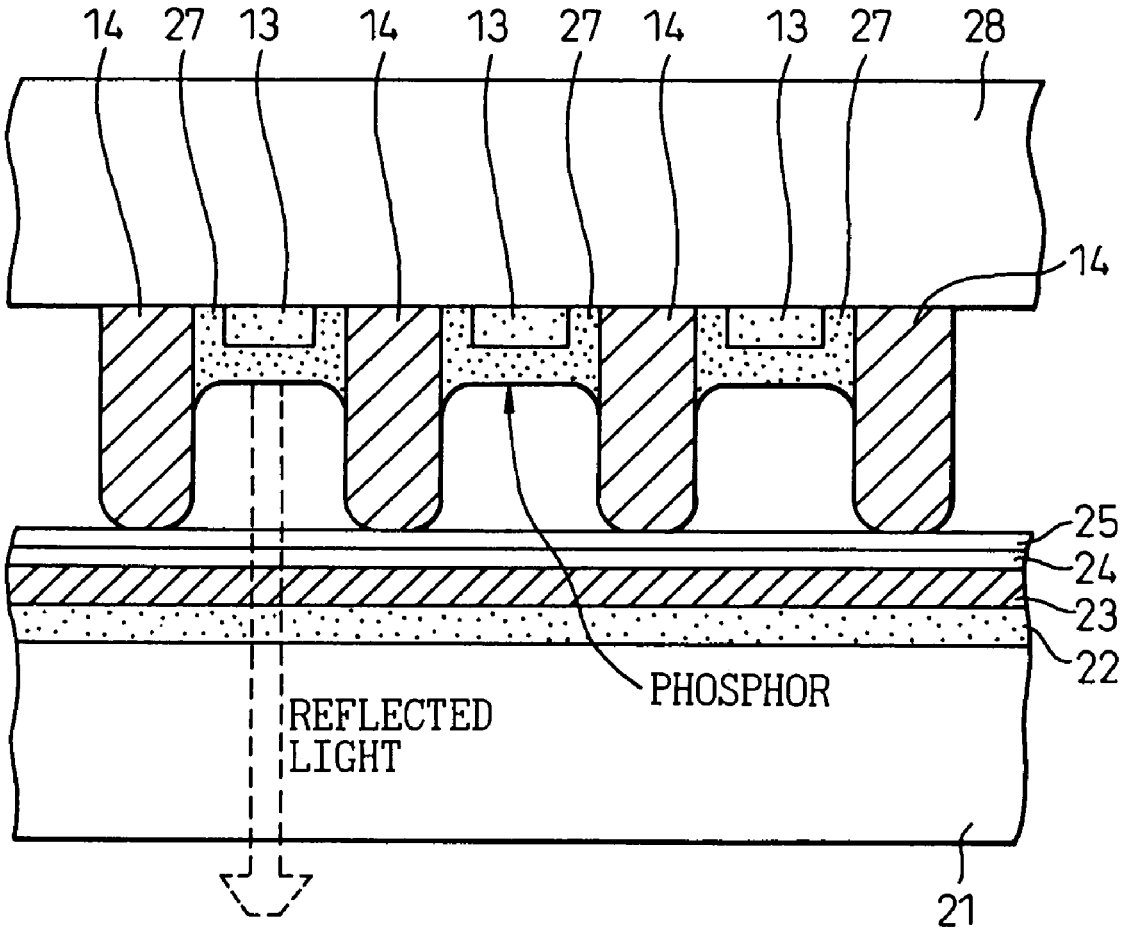
FIG. 3 is a rough sectional view of the three-electrode surface discharge AC type PDP.
Figure 4:
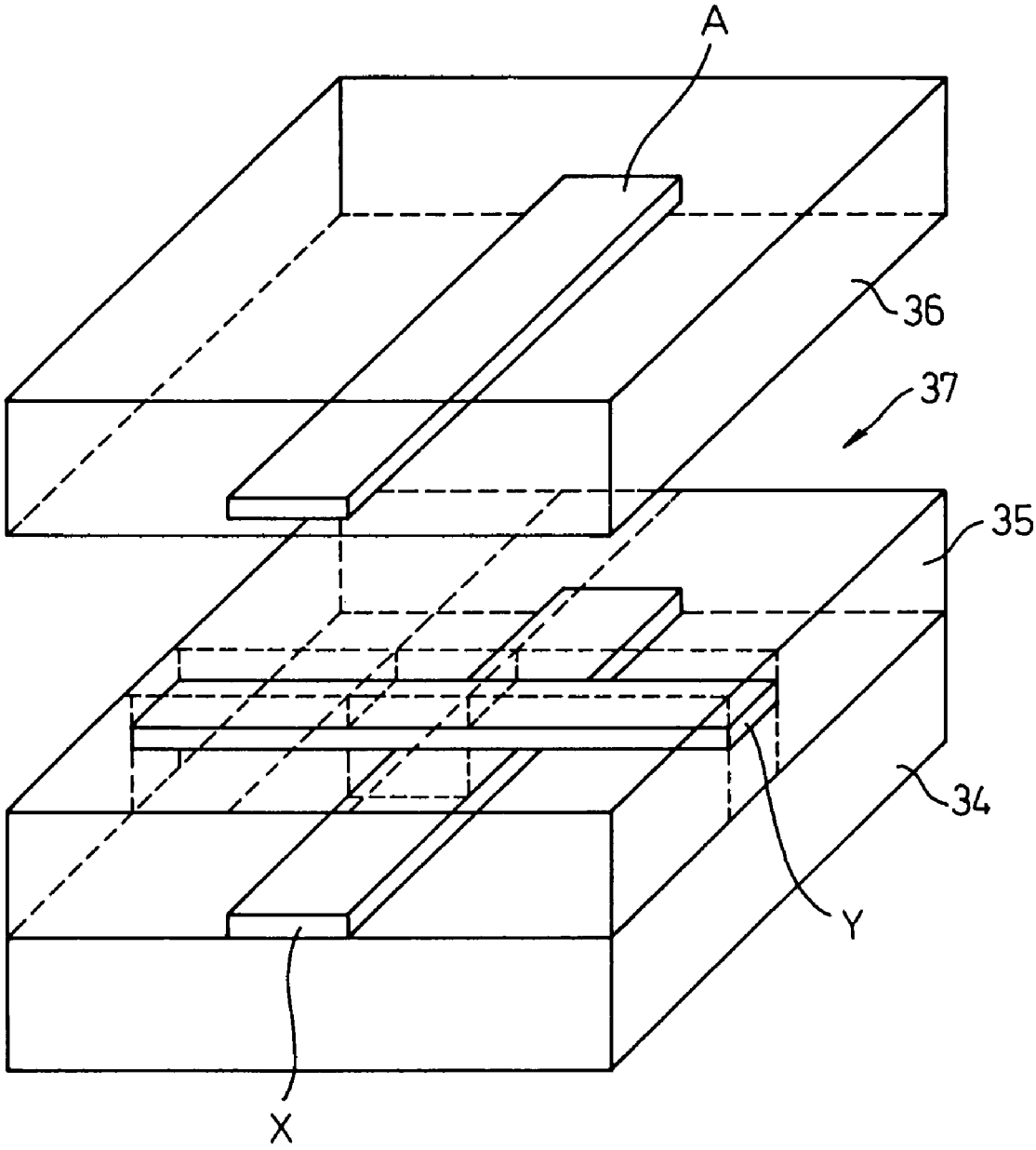
FIG. 4 is a diagram that shows the fundamental structure of the PDP apparatus of the present invention.
Figure 7:
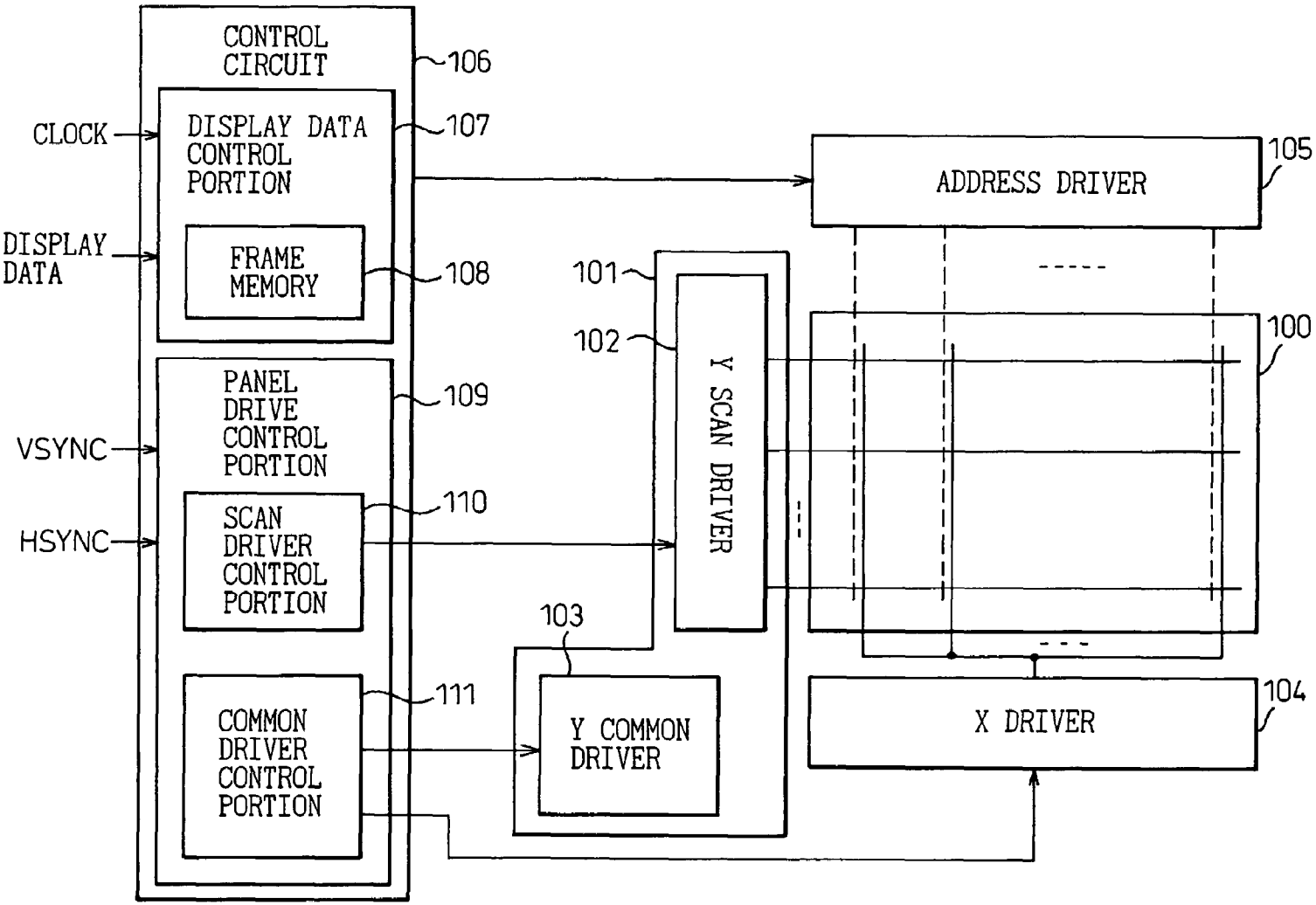
FIG. 7 is a block diagram that shows the rough structure of the PDP apparatus in the embodiments of the present invention.

FIG. 7 is a block diagram that shows the rough structure of the PDP apparatus in the embodiments of the present invention. As shown schematically, the PDP apparatus comprises a PDP 100 that has the structure as shown in FIG. 4, a Y driver 101 that drives the Y electrode, an X driver 104 that drives the X electrode, an address driver 105 that drives the address electrode, and a control circuit 106. The Y driver 101 comprises a Y scan driver 102 and a Y common driver 103. The control circuit 106 comprises a display data control portion 107 and a panel drive control portion 109. The display data control portion 107 comprises a frame memory 108. The panel drive control portion 109 comprises a scan driver control portion 110 and a common driver control portion 111. Except that the PDP 100 has the structure as shown in FIG. 4, other parts of the structure are almost the same as the conventional three-electrode surface discharge AC type PDP apparatus, and each driver can be realized as conventionally and, therefore, a detailed description is omitted here.

Figure 8:
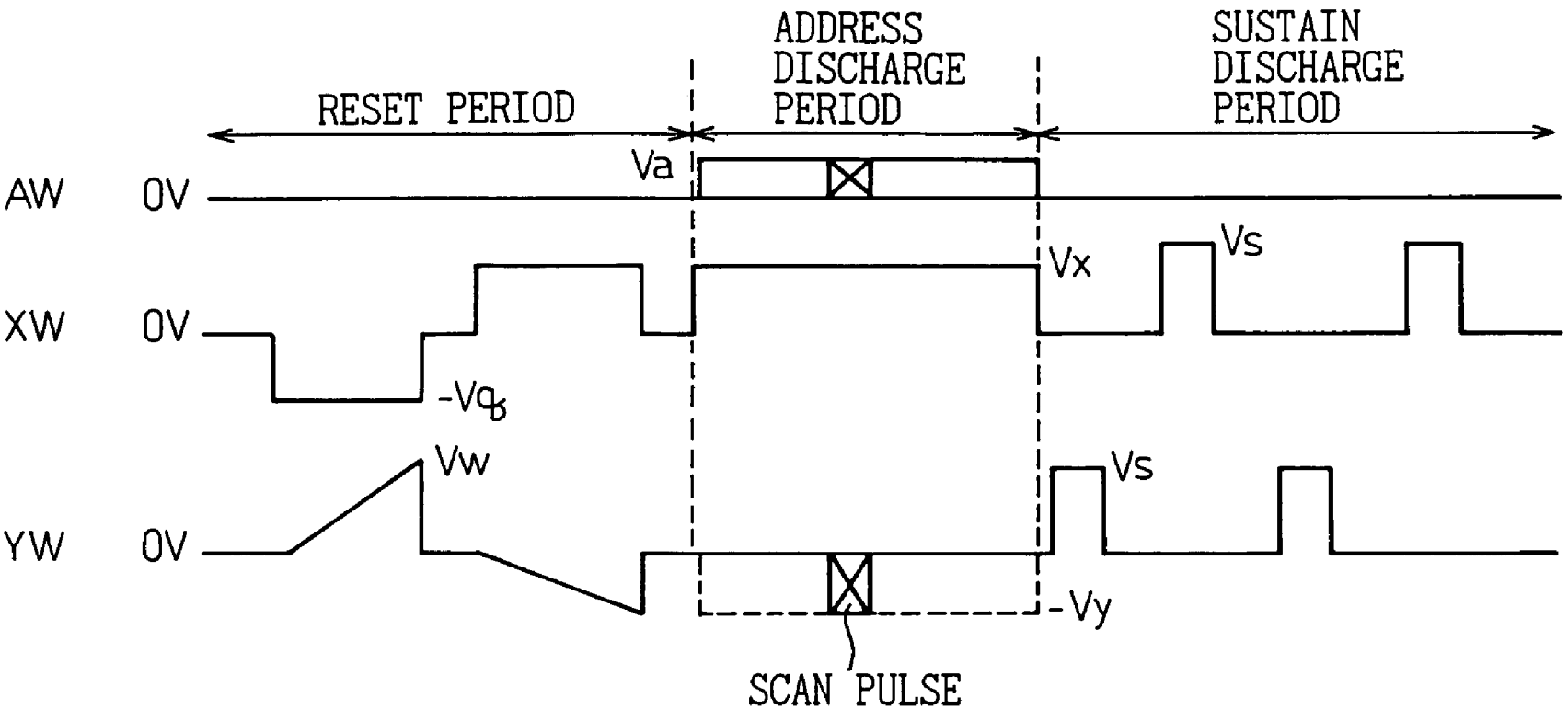
FIG. 8 is a diagram that shows the drive waveforms of each electrode in the embodiments.

FIG. 8 is a diagram that shows the drive waveforms in the embodiments of the present invention, and AW is the waveform to be applied to the address electrode A, XW is that to be applied to the common electrode x, and YW is that to be applied to the scan electrode Y. As shown schematically, the drive action is composed of three periods, that is, a reset period, an address discharge period, and a sustain discharge period as conventionally, and these periods are repeated.

In the reset period, with a state in which 0V is being applied to the address electrode A, a pulse of voltage −Vq is applied to the common electrode X and at the same time a slope-shaped pulse, the voltage of which increases to Vw at a fixed rate, is applied to the scan electrode Y to cause an erase discharge to occur, then a pulse of voltage Vq is applied to the common electrode X and at the same time a slope-shaped pulse, the voltage of which decreases to a fixed negative voltage at a fixed rate, is applied to the scan electrode Y to cause a neutralize discharge to occur, thereby all the display cells are made to enter a uniform state. By applying such a slope-shaped pulse, the intensity of the erase discharge that lowers the contrast is lowered and all the display cells are made to enter a uniform state without fail.

Figure 5A:
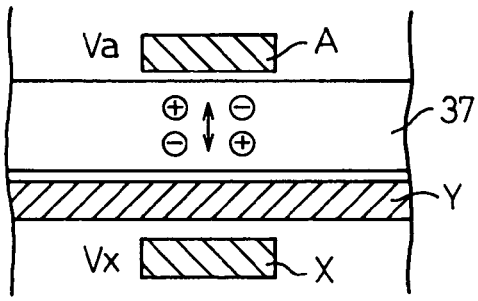
FIG. 5A through FIG. 5E are diagrams that illustrate the operation of the PDP apparatus of the present invention.
Figure 5B:
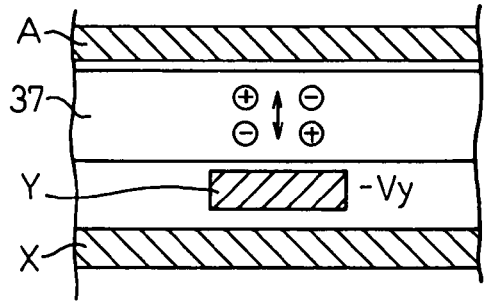
Figure 5C:
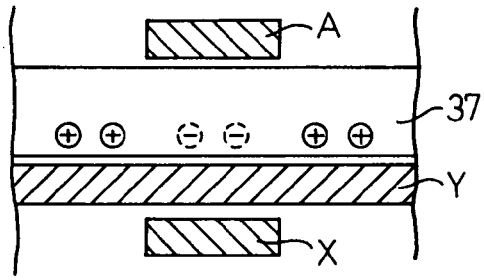
Figure 5D:
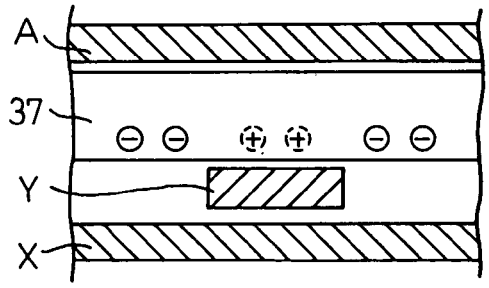
Figure 5E:
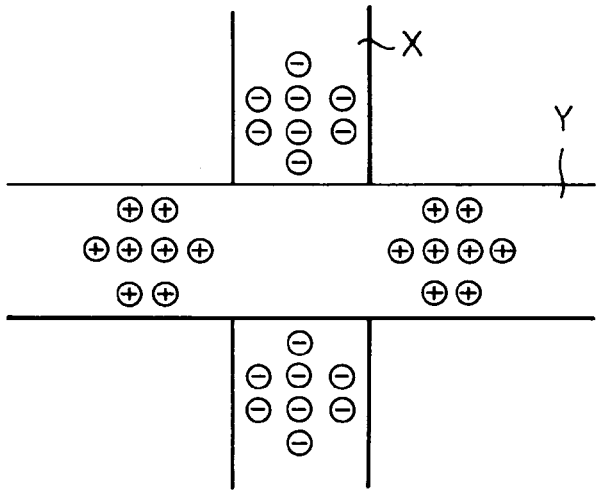

Next, in the address discharge period, with a state in which a voltage Vx is being applied to the common electrode X, a scan pulse of voltage −Vy is applied sequentially to the scan electrode Y and a write pulse of voltage Va is applied to the address electrode A of a cell to be lit in synchronization with the application of the scan pulse. In this way, a discharge is caused to occur at the crossing portion of the address electrode A to which the voltage Va has been applied and the scan electrode Y, space charges are generated as shown in FIG. 5A and FIG. 5B, and wall charges are accumulated with a distribution shown in FIG. 5E according to the electric field formed between the common electrode X to which the voltage Vx is being applied and the scan electrode Y to which the scan pulse of voltage −Vy is being applied. By performing such an action to every scan electrode Y by sequentially applying a scan pulse, all the display cells are set to a state corresponding to the display data.

Figure 6A:
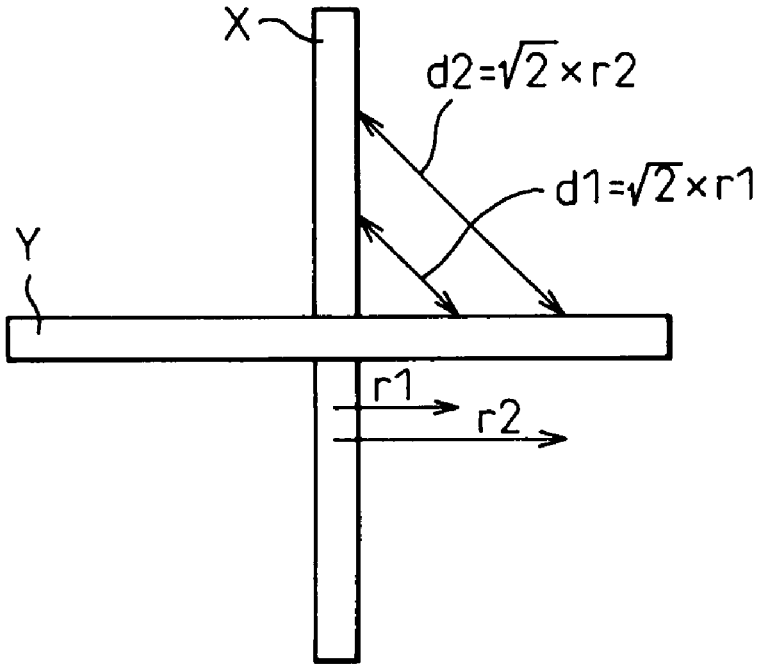
FIG. 6A and FIG. 6B are diagrams that illustrate the operation of the PDP apparatus of the present invention.
Figure 6B:
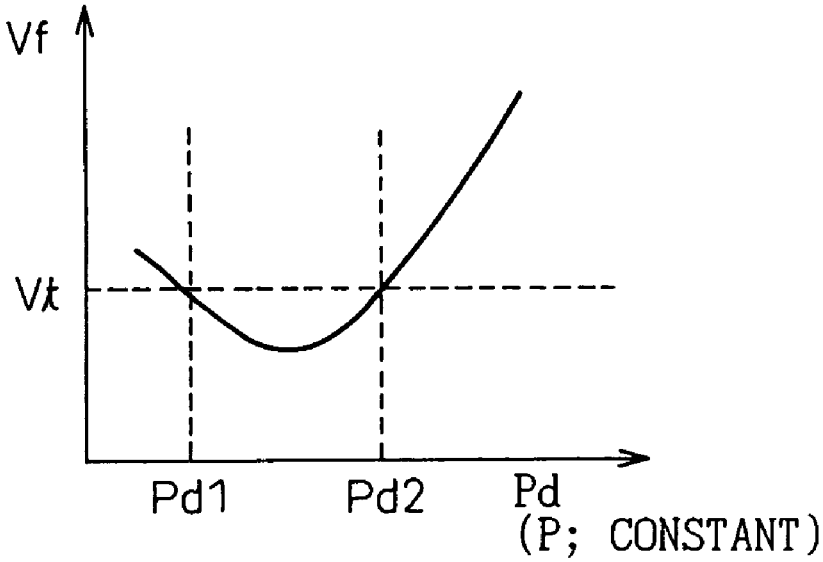

In the next sustain discharge period, after a sustain pulse of voltage Vs is applied to the scan electrode Y, a sustain pulse is applied alternately to the common electrode X and the scan electrode Y in this order. In this way, a sustain discharge is caused to occur in the vicinity of the crossing portion of a cell to be made to emit light as described in FIG. 6A and FIG. 6B, and the display is performed. The above-mentioned reset period, address discharge period, and sustain discharge period are repeated.

While the structure and the operation of the PDP apparatus in the embodiments of the present invention have been described as above, examples of the structure in the embodiments are described in detail below.

Figure 9A:
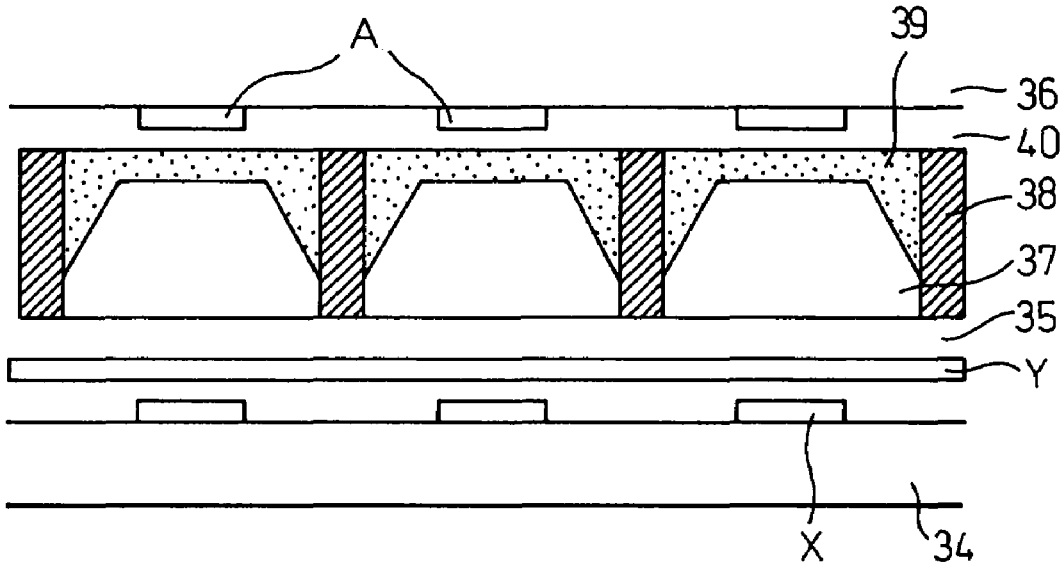
FIG. 9A and FIG. 9B are diagrams that show examples of the PDP structure.

According to the present invention, the address discharge is limited to the crossing portion and the sustain discharge is limited in the vicinity of the crossing portion, therefore, it is possible to omit the partition wall used conventionally, but it is also possible to provide the partition wall because of its role as a spacer that defines the interval between the substrates. FIG. 9A is a diagram that shows an example of the structure of a PDP that has the partition wall. In this example, the common electrode X is formed on the first substrate 34 made of glass, the scan electrode Y is firmed thereon via the dielectric layer, and the dielectric layer 35 is further provided on the surface thereof. On the other hand, the address electrode A is formed on the second substrate 36 made of glass, a dielectric layer 40 is formed thereon, a partition wall 318 is further formed between the address electrodes A, and a phosphor 39 is formed therebetween. The partition wall 38 comes into contact with the surface of the first substrate 34 and also serves as a spacer that defines the thickness of the discharge space 37. The phosphor 39 is excited by the discharge that occurs in the discharge space 37 and emits light. Light can be emitted not only from the first substrate 34 side on which the common electrode X and the scan electrode Y have been formed (reflection type) but also from the second substrate 36 side on which the phosphor 39 has been formed (transparent type). The materials to form the common electrode X, the scan electrode Y, and the address electrode A can be transparent materials such as ITO or opaque metal materials, and it is also acceptable that the electrodes made thereof are combined. Either way, by providing the partition wall, the propagation of the discharge can be more surely suppressed.

Figure 9B:
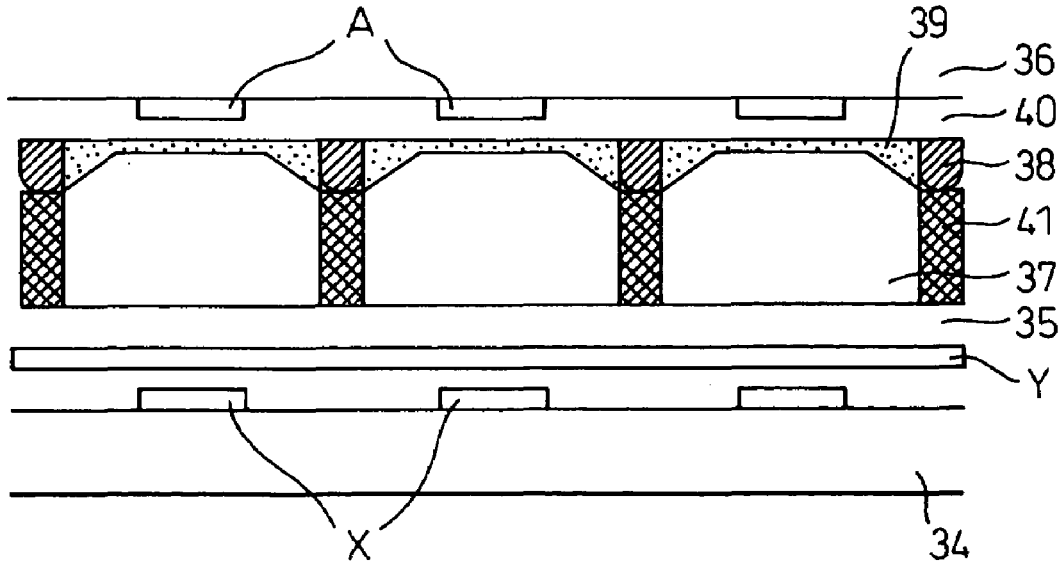

In FIG. 9B, the height of the partition wall 38 is decreased and a space 41 is further provided in the structure shown in FIG. 9A. The partition 38 is used to distinguish among the phosphors 39. In the present invention, it is not necessary to provide a partition wall to prevent the propagation of the discharge, and since the space 41 is required only to define the interval between the substrates, it is not necessary to provide partition walls at the same intervals as the partition walls 38, and the direction of forming and the figures are arbitrary, but in FIG. 9B, the partition wall 38 and the spacer 41 are overlapped with each other. The spacer 41 can be provided, for example, at every several partition walls, or between the scan electrodes Y so as to be perpendicular to the partition wall. Moreover, the space 41 can have not only a wall structure but also a cylindrical or a spherical structure.

Figure 10A:
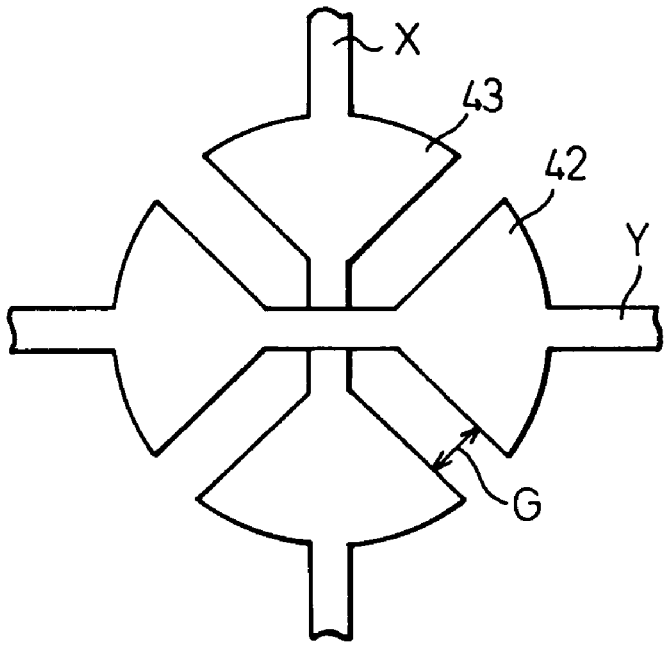
FIG. 10A and FIG. 10B are diagrams that show examples of the electrode figure.
Figure 10B:
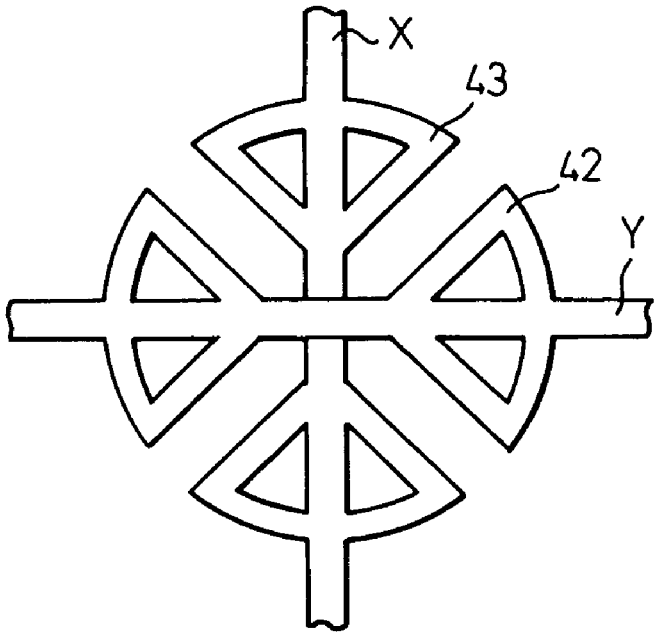

FIG. 10A and FIG. 10B are diagrams that show examples of the electrode figure to which common auxiliary electrodes 43 and scan auxiliary electrodes 42 to widen the common electrode X and the scan electrode Y in the vicinity of the crossing portion are provided. In the example of FIG. 10A, the auxiliary electrode is formed so as to be a sector-shaped figure, the center of which being at a point a little distance away from the crossing portion of the common electrode x and the scan electrode Y and spreading outward, and the common auxiliary electrode 43 and the scan auxiliary electrode 42 are made so that their opposing radii are parallel with a fixed gap G. Although the effects are the same regardless of the materials of the auxiliary electrode, that is, metal or transparent one, it is preferable to use the transparent material for the reflection type because the light generated by the phosphor 39 can pass therethrough. Moreover, although the auxiliary electrode is provided to both the common electrode X and the scan electrode Y in the example of the figure, it is also possible to provide the auxiliary electrode to only one of the common electrode X and the scan electrode Y. In the example of the figure, on the other hand, the gap between the opposing radii of the common auxiliary electrode 43 and the scan auxiliary electrode 42 is made fixed, but it is also possible to employ a structure in which the gap is not fixed and to suppress the instantaneous discharge current by causing the discharge to occur scatteringly. Either way, there are various examples of modification of the figures of the auxiliary electrode.

In FIG. 10B, for example, the area of the auxiliary electrode shown in FIG. 10A is reduced by removing the inner part thereof. In this way, for the reflection type, the amount of the emitted light that passes through can be improved and a sufficient luminance can be obtained even if the auxiliary electrodes are formed only by metal electrodes.

Figure 11A:
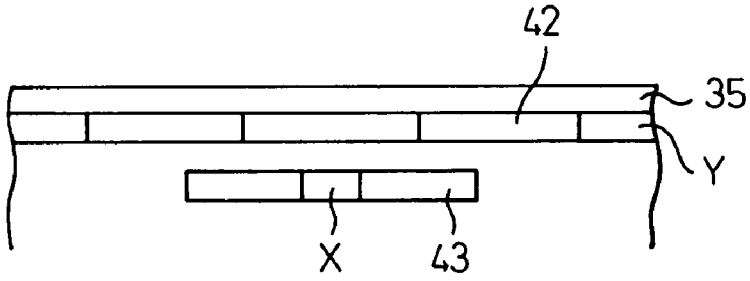
FIG. 11A through FIG. 11H are diagrams that show examples of the electrode structure.
Figure 11B:
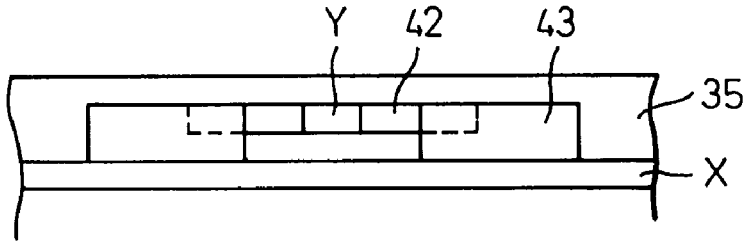

When the common auxiliary electrode 43 and the scan auxiliary electrode 42 as described above are formed, the heights of them are made equal to those of the common electrode X and the scan electrode Y, respectively. FIG. 11A is a diagram that shows the structure in this case, in which the common auxiliary electrode 43 is formed so as to be flush with the common electrode X and the scan auxiliary electrode 42 is formed so as to be flush with the scan electrode Y on the first substrate. In this case, the level of the common auxiliary 43 is different from that of the scan auxiliary electrode 42, and the common auxiliary electrode 43 is larger in thickness with respect to the surface that comes into contact with the discharge space 37. It is more preferable that the thickness is smaller because the drive voltage can be less. Therefore, as shown in FIG. 11B, the common auxiliary electrode 43 is formed so as to have the same level with the scan electrode Y and the scan auxiliary electrode 42 by going round them, and is connected to the common electrode X formed at a different level.

Figure 11C:
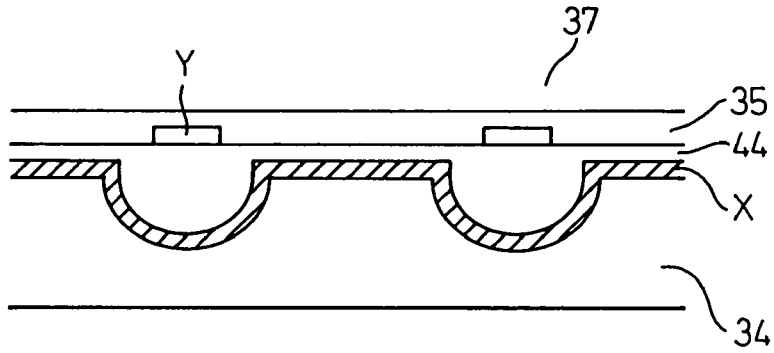

In the structure shown in FIG. 4, since the scan electrode Y and the common electrode X are arranged at the crossing portion via the dielectric 35, the electrostatic capacity between the scan electrode Y and the common electrode X becomes large and the drive performance of the driver needs to be increased. Therefore, as shown in FIG. 11C, the common electrode X is formed after a groove is formed along the crossing portion or the portion where the scan electrode Y is formed on the first substrate 34. Then a dielectric layer 44 is formed so that the surface is flat and the scan electrode Y and the dielectric layer 35 are formed thereon. In this way, the electrostatic capacity at the crossing portion of the scan electrode Y and the common electrode X can be reduced. If such a structure is employed, it is possible to provide the scan electrode Y and the common electrode X at the same level of those on the first substrate except for the crossing portion.

Figure 11D:
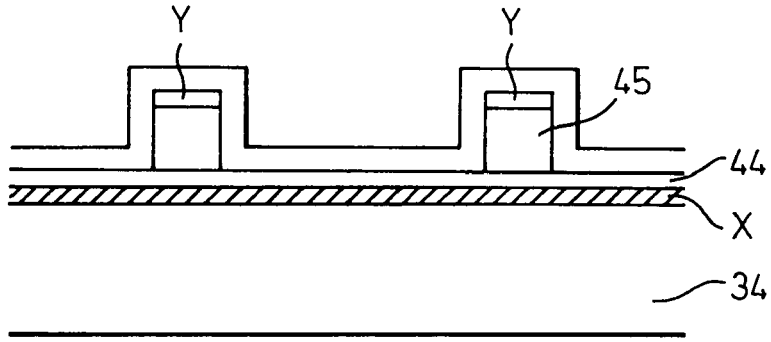

As shown in FIG. 11D, on the other hand, after the common electrode X is formed on the first substrate 34, a partition-shaped structure 45 made of dielectric material is formed along the crossing portion or the portion where the scan electrode Y is formed, and the scan electrode Y is formed thereon. In this way, the electrostatic capacity at the crossing portion of the scan electrode Y and the common electrode X can be reduced and at the same time the propagation of the discharge can be further suppressed because the distance between the scan electrode Y and the common electrode X increases. Moreover, it is possible to lower the discharge start voltage by manufacturing the portion between the common electrode X and the scan electrode Y of the crossing portion using a material that easily emits electrons.

Figure 11E:
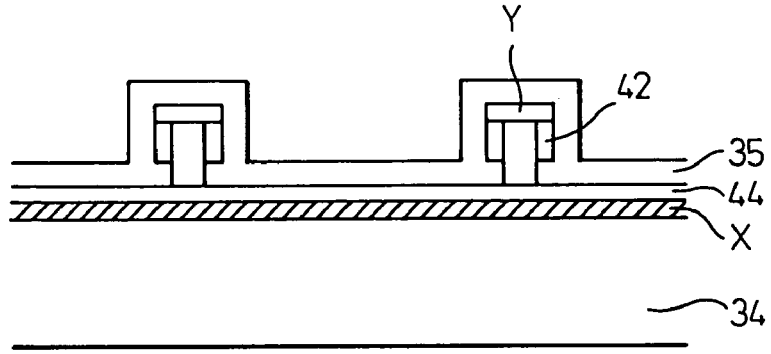

Still furthermore, as shown in FIG. 11E, by forming the scan auxiliary electrode 42 on the side of the structure 45 in FIG. 11D, the electrode gap between the scan electrode Y and the common electrode X can be suppressed from excessively increasing, and an adequate electrode gap can be obtained.

Figure 11F:
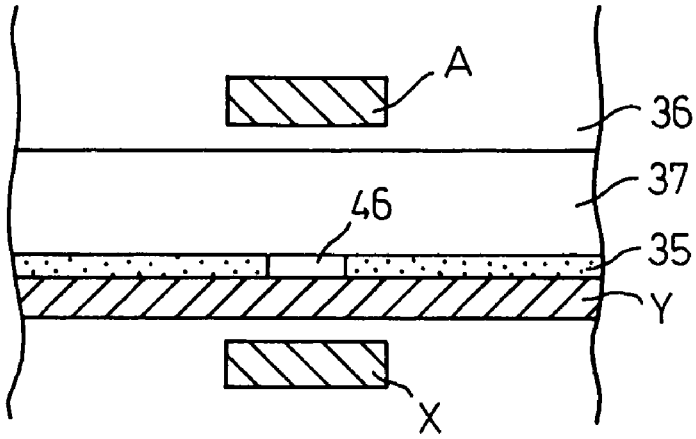

FIG. 11F is a diagram that shows an example, of an electrode structure, in which a hole 46 is provided in the dielectric layer 35 on the crossing portion of the scan electrode Y so that the scan electrode Y is exposed to the discharge space. The sustain discharge is caused to occur only at a portion away a certain distance from the crossing portion of the scan electrode Y, and the crossing portion is required only to generate charges by a discharge between the crossing portion and the address electrode A, but not to accumulate wall charges. Therefore, part of the scan electrode Y can be exposed to the discharge space, resulting in the reduction in the voltage needed for the address discharge.

Figure 11G:
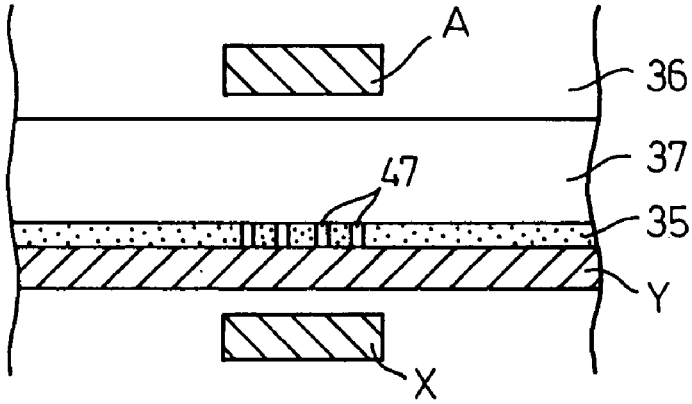

The whole of the crossing portion of the scan electrode does not have to be exposed, and it is also acceptable that plural small pores 47 are provided in the crossing portion of the scan electrode Y so that part of the scan electrode Y is exposed to the discharge space 37, as shown in FIG. 11G.

Figure 11H:
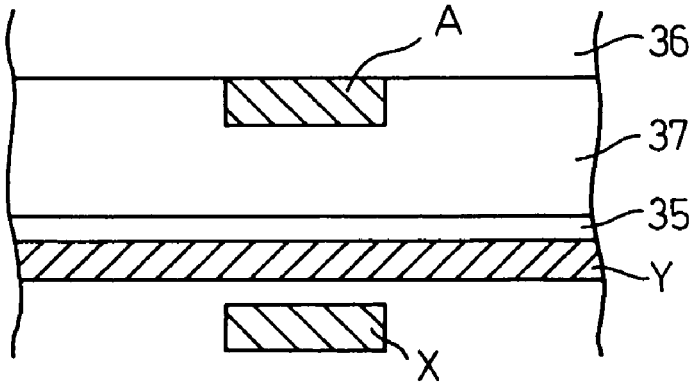

As shown in FIG. 11H, the voltage needed for the address discharge can be also lowered, similarly, even if the address electrode A is exposed to the discharge space 37.

Figure 12A:
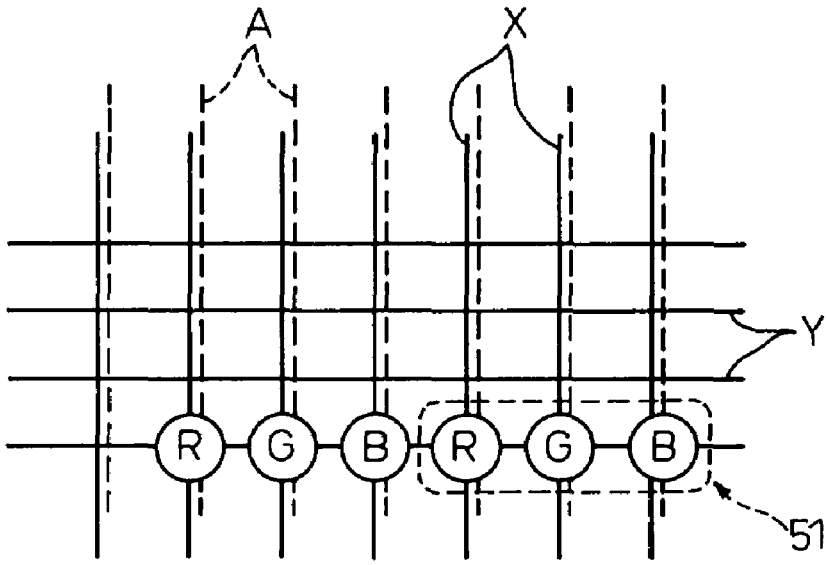
FIG. 12A and FIG. 12B are diagrams that show examples of correspondence between the color pixels and the display cells.
Figure 12B:
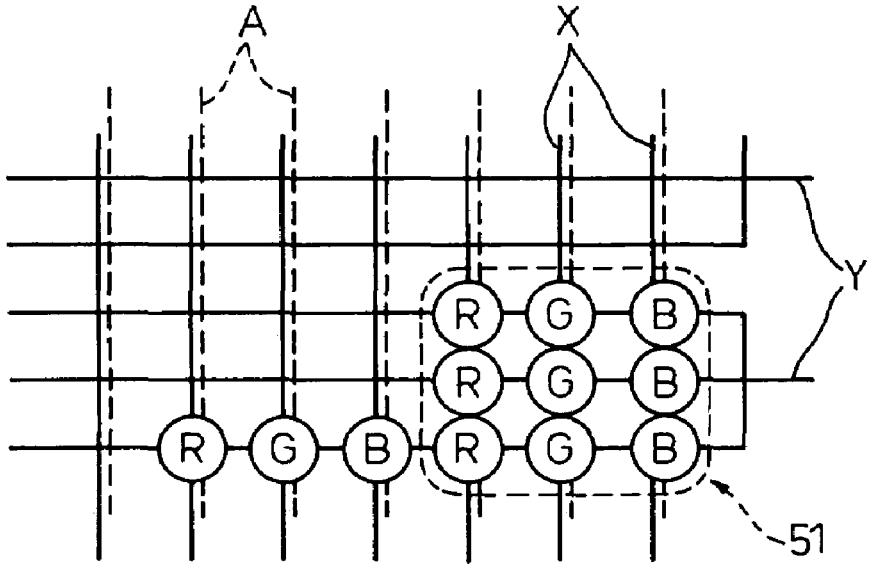

FIG. 12A is a diagram that shows an example of correspondence between the color pixels and the display cells in a PDP apparatus that performs a color display. In this example, a one-color pixel 51 is composed of the three display cells that are formed along the scan electrode Y and adjacent horizontally, and the phosphors R (red), G (green), and B (blue) are formed in the three display cells, respectively. In the example of FIG. 12A, the arrangement pitch of the scan electrode Y is the same as those of the common electrode X and the address electrode A, and in the case of monochrome display, the pixel pitch in the horizontal direction is the same as that in the vertical direction, but the color pixel pitch in the horizontal direction is three times that in the vertical direction and the shape is like a horizontally wide rectangle (a rectangle the width of which is much greater than its length).

It is preferable for the color pixel to have the same pixel pitch in the horizontal direction and in the vertical direction. Therefore, if a scan pulse is applied, the three adjacent scan electrodes Y being classified into one group, the lit state or the unlit state of the three adjacent display cells formed by the three adjacent scan electrodes can be simultaneously selected by one scan pulse. In other words, the pixel of each color is composed of three display cells adjacent vertically and the shape is like a vertically extended rectangle (a rectangle the height of which is much greater than its width). Since a one-color pixel is composed of 3×3, that is nine, display cells, the color pixel pitch in the horizontal direction is the same as that in the vertical direction.

Figure 13:
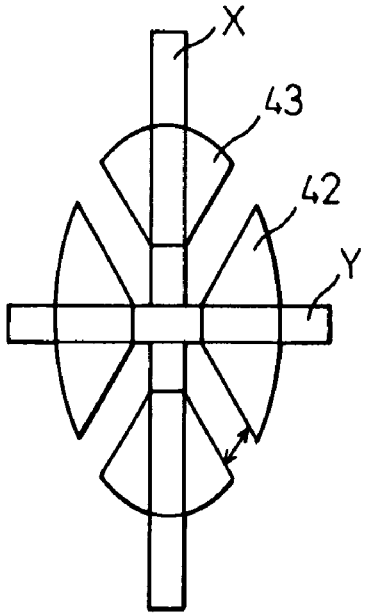
FIG. 13 is a diagram that shows an example of the electrode figure.

It is possible to make the color pixel pitch in the horizontal direction equal to that in the vertical direction even if the arrangement pitch of the scan electrode Y is made three times those of the common electrode X and the address electrode A. In the structure shown in FIG. 4 or FIG. 6A, however, in which the common electrode X is perpendicular to the scan electrode Y, the light emission area is almost circular and the density of display cells in the vertical direction is lowered, therefore a problem, that a sufficient luminance cannot be obtained, is caused. Therefore, it is acceptable that the common auxiliary electrode 43 and the scan auxiliary electrode 42 that are vertically lengthened are provided as shown in FIG. 13 so that the light emission area has a shape of a vertically long rectangle can be obtained.

Figure 14:
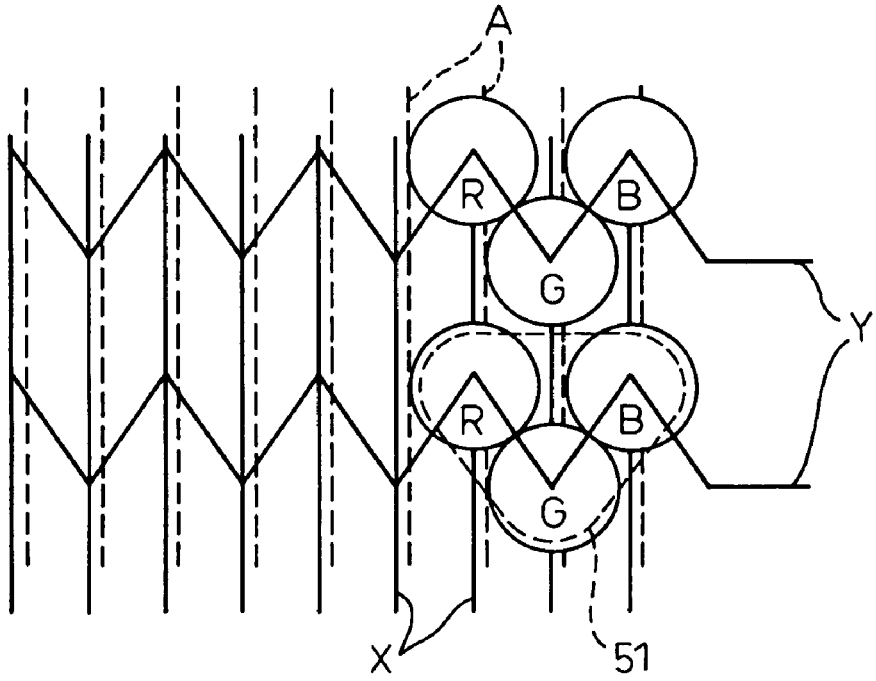
FIG. 14 is a diagram that shows an example of the color pixel configuration and the electrode arrangement.

In these examples, the scan electrode Y extends linearly. In FIG. 14, however, the scan electrodes Y are constructed so that the scan electrode Y extends in zigzag, turning at the crossings of the scan electrode Y and the common electrode X and the address electrode Y, the successive three crossings being the vertexes of an equilateral triangle. In the figure, the R pixel and the B pixel are arranged on the upper side and the G pixel, on the lower side, but in the case of a group in which pixels are horizontally adjacent, the R pixel and the B pixel are arranged on the lower side and the G pixel, on the upper side. In such a structure, although a one-color pixel has a figure of an equilateral triangle, it is possible to substantially make the pixel pitch of the one-color pixel in the horizontal direction equal to that in the vertical direction.

Figure 15:
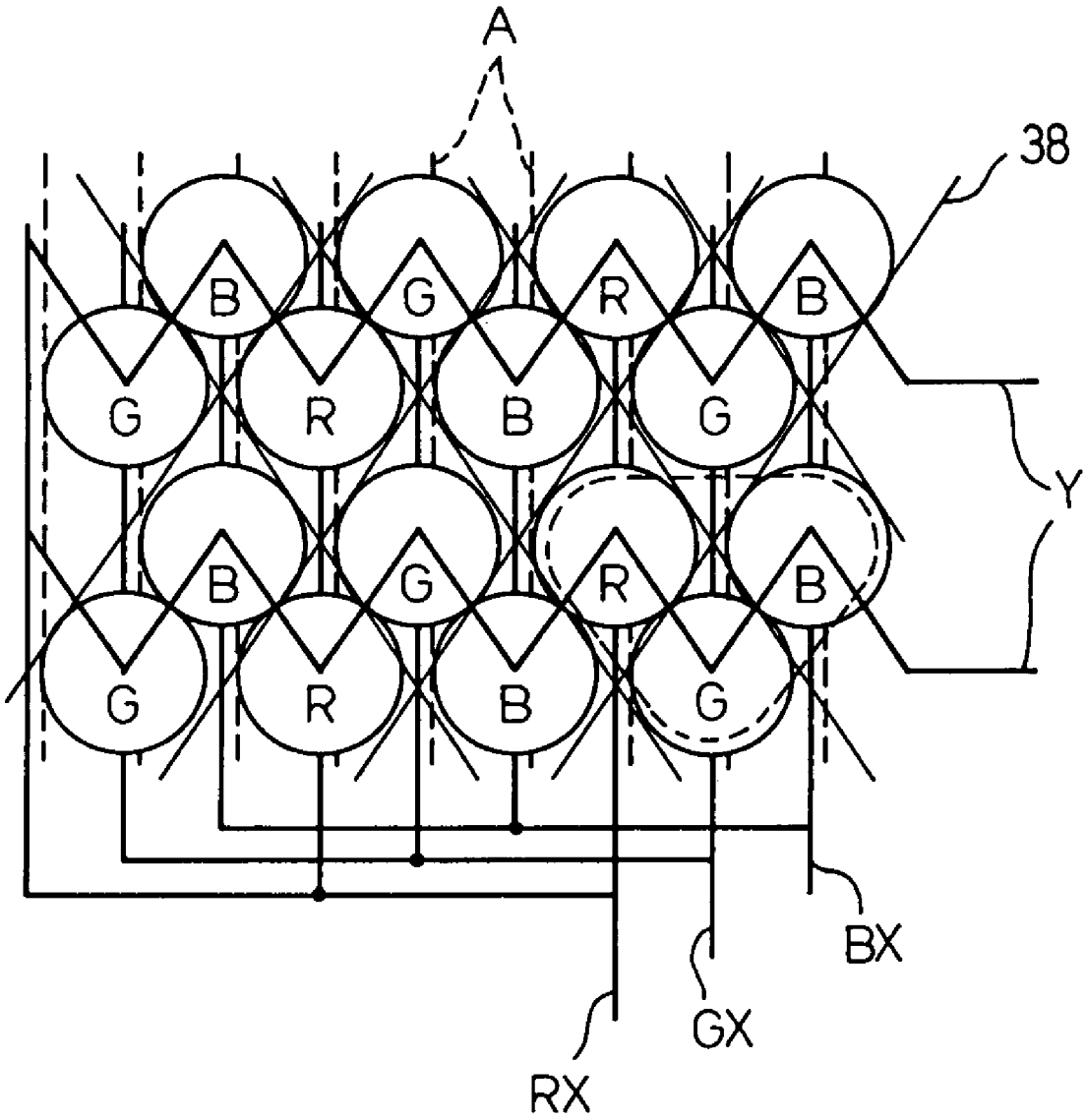
FIG. 15 is a diagram that shows an example of the color pixel configuration and the electrode arrangement.
Figure 16A:
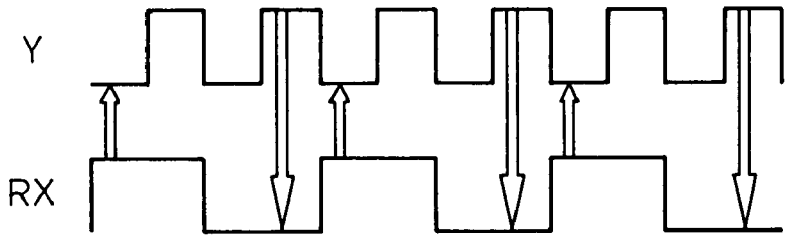
FIG. 16A through FIG. 16C are diagrams that show the drive waveforms of the PDP apparatus shown in FIG. 15.
Figure 16B:
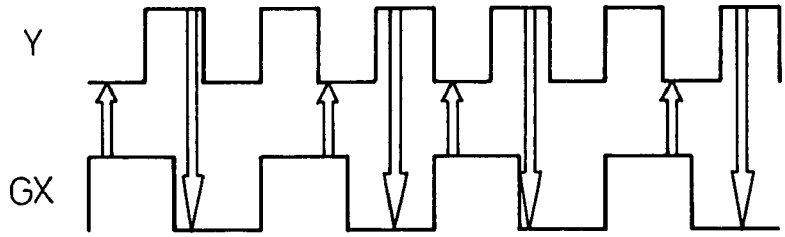
Figure 16C:
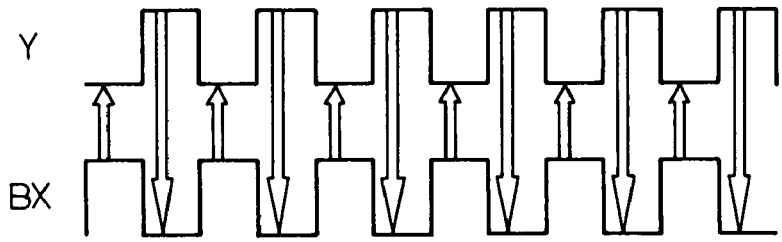

In the embodiments described so far, the common electrodes X are commonly connected and it is assumed that the same drive voltage is applied. On the contrary, in FIG. 15, the common electrodes X are divided into three groups to be driven independently: a common electrode group RX that forms the display cell of the R pixel; a common electrode group GX that forms the display cell of the G pixel; and a common electrode group BX that forms the display cell of the B pixel. FIG. 16A through FIG. 16C are diagrams that show examples of the drive waveforms in the sustain discharge period that drive a PDP apparatus that has the structure shown in FIG. 15, and FIG. 16A shows the drive waveforms of the common electrode group RX, FIG. 16B shows those of the common electrode group GX, FIG. 16C shows those of the common electrode group BX, and an arrow indicates a discharge. As shown schematically, the drive waveforms of the scan electrode Y are the same and the number of times of sustain discharge in a fixed period can be altered by varying the drive frequency of the common electrode groups RX, GX, and BX. In this example, the ratio of the number of times of sustain discharges in a fixed period for the common electrode groups RX, GX, and BX is 1:1.5:2.

The light emission efficiency of each phosphor for R; G, and B is different and if the ratio is assumed to be 2:1.5:1, the ratio of the display luminance for each color will be the same when driven at the same sustain discharge frequency, and this is not preferable from the standpoint of color reproduction characteristic. If the structure as shown in FIG. 15 is employed and driven as shown in FIG. 16A through FIG. 16C, each term of the display luminance ratio becomes identical for each color and the color reproducibility can be improved.

As described above, according to the present invention, it is possible to not only realize a PDP apparatus in which an erroneous display due to the propagation of discharge is not caused and the density of display cells is high, but also reduce power consumption and costs because the range of each display cell can be regulated by the structure of electrodes.

We claim:

1. A plasma display apparatus, comprising:

plural common electrodes formed on a first substrate and extending in a first direction;

plural scan electrodes formed on the first substrate and extending in a second direction perpendicular to the first direction; and plural address electrodes formed on a second substrate, opposed to the first substrate and extending in the first direction, and each address electrode is aligned with a respective common electrode, wherein:

the scan electrode is provided on a side near the address electrode at the crossing portion of the common electrode and the scan electrode on the first substrate and the common electrode is provided under the scan electrode via a dielectric, a discharge space is formed between the first substrate and the second substrate, a display cell is formed at a crossing portion of each common electrode and address electrode pair and each scan electrode, a lit state or an unlit state of each display cell is selected by applying, in individual succession, scan pulses to the plural scan electrodes and, synchronously with the scan pulses, selectively applying address pulses to the plural address electrodes, and a sustain discharge is produced in each display cell selected to be lit by applying sustain pulses between the plural common electrodes and the plural scan electrodes.

2. The plasma display apparatus as set forth in claim 1, wherein each common electrode has a step to avoid contact with each scan electrode and protrudes downward at the crossing portion.

3. The plasma display apparatus as set forth in claim 1, wherein each scan electrode has a step to avoid contact with each common electrode and protrudes upward at the crossing portion.

4. The plasma display apparatus as set forth in claim 1, further comprising:

a dielectric layer comprising a width that is almost the same as that of the scan electrodes, beneath the scan electrodes.

5. The plasma display apparatus as set forth in claim 1, wherein the address electrodes are exposed to the discharge space.

6. The plasma display apparatus as set forth in claim 1, wherein part of each scan electrode at the crossing portion is exposed to the discharge space.

7. The plasma display apparatus as set forth in claim 6, further comprising:

plural pores that connect the discharge space and each surface of each scan electrode at the crossing portion of each scan electrode.

8. The plasma display apparatus as set forth in claim 1, wherein the common electrodes and the scan electrodes, respectively, have common auxiliary electrodes and scan auxiliary electrodes that are connected to the common electrodes and the scan electrodes, respectively, and widen the common electrodes and the scan electrodes, respectively.

9. The plasma display apparatus as set forth in claim 8, wherein depths of surfaces of the common auxiliary electrodes and the scan auxiliary electrodes, with respect to the surface that comes into contact with the discharge space, are the same.

10. The plasma display apparatus as set forth in claim 1, further comprising:

partition walls on a surface of the second substrate so as to separate the address electrodes.

11. The plasma display apparatus as set forth in claim 10, wherein the partition walls define an interval between the first substrate and the second substrate.

12. The plasma display apparatus as set forth in claim 10, further comprising:

spacers, which define the interval between the first substrate and the second substrate together with the partition walls.

13. A The plasma display apparatus as set forth in claim 1, wherein an arrangement pitch of the plural scan electrodes is the same as the arrangement pitch of the plural common electrodes and the plural address electrodes.

14. The plasma display apparatus as set forth in claim 13, wherein three adjacent plural scan electrodes are classified into one group, the scan pulses are applied in individual succession to the scan electrodes of each group, and three adjacent display cells formed by the three adjacent scan electrodes have the same lit or unlit state.

15. The plasma display apparatus as set forth in claim 1, wherein an arrangement pitch of the plural scan electrodes is three times the arrangement pitch of the plural common electrodes and the plural address electrodes.

16. The plasma display apparatus as set forth in claim 15, wherein the common electrodes and the scan electrodes, respectively, have common auxiliary electrodes and a scan auxiliary electrodes that are connected to the common electrodes and the scan electrodes, respectively, and widen the common electrodes and the scan electrodes, respectively, in a vicinity of the crossing portion and the common auxiliary electrodes and the scan auxiliary electrodes have an elliptical shape, a length-to-width ratio of which is, on a whole, 3:1.

17. The plasma display apparatus as set forth in claim 1, wherein the scan electrode runs in zigzag so that the crossing point of each scan electrode and each common electrode forms a vertex.

18. The plasma display apparatus as set forth in claim 1, wherein three display cell columns formed by three pairs, each comprising one of the common electrodes and the address electrodes, form three different color pixel columns, respectively.

19. The plasma display apparatus as set forth in claim 1, wherein the common electrodes are classified into groups by light emission color of the display cell, each group is independently driven, and the sustain pulses are applied at a different period for each group.

20. A plasma display apparatus, comprising:

a first substrate, comprising:

common electrodes extending in a first direction, and scan electrodes extending in a second direction perpendicular to the first direction; and a second substrate, opposite to the first substrate, comprising:

address electrodes extending in the first direction, each address electrode being aligned with a respective common electrode, a discharge space between the first substrate and the second substrate, and a display cell at a crossing portion of each common electrode and address electrode pair and each scan electrode.

21. A plasma display apparatus, comprising:

a first substrate, comprising:

common electrodes extending in a first direction, and scan electrodes extending in a second direction perpendicular to the first direction; and a second substrate, opposite to the first substrate with a dielectric gap therebetween, comprising:

address electrodes extending in the first direction, each address electrode being aligned with a respective common electrode as a corresponding pair thereof, and a display cell being defined at a crossing portion of each scan electrode and aligned pair of a common electrode and address electrode.

* * * * *

UNITED STATES PATENT AND TRADEMARK OFFICE

CERTIFICATE OF CORRECTION

PATENT NO. : 7,164,394 B2
APPLICATION NO. : 10/102017
DATED : January 16, 2007
INVENTOR(S) : Tadatsugu Hirose et al.

It is certified that error appears in the above-identified patent and that said Letters Patent is hereby corrected as shown below:

Column 14, Line 40, delete “A” before “The”.

Signed and Sealed this

Third Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 7,164,394 B2
APPLICATION NO. : 10/102017
DATED : January 16, 2007
INVENTOR(S) : Tadatsugu Hirose et al.

It is certified that error appears in the above-identified patent and that said Letters Patent is hereby corrected as shown below:

On the Title Pg, Item (73) Assignee:, delete "HITACHI LTD." and add --HITACHI, LTD. AND FUJITSU HITACHI PLASMA DISPLAY LIMITED--.

Signed and Sealed this

Fifth Day of January, 2010

David J. Kappos

David J. Kappos
*Director of the United States Patent and Trademark Office*